US005647749A

United States Patent [19]

Atoh et al.

[11] Patent Number: 5,647,749

[45] Date of Patent: Jul. 15, 1997

[54] ELECTRICAL CONNECTOR ASSEMBLY

[75] Inventors: Kiyoshi Atoh, Tokyo; Etsuro Doi, Saitama; Shoichi Mochizuki; Mazakazu Koiso, both of Tama, all of Japan

[73] Assignee: Kel Corporation, Tokyo, Japan

[21] Appl. No.: 308,802

[22] Filed: Sep. 19, 1994

[30] Foreign Application Priority Data

Sep. 17, 1993 [JP] Japan ..... 5-255041

[51] Int. Cl.[6] ..... H01R 9/09

[52] U.S. Cl. ..... 439/79; 439/686

[58] Field of Search ..... 439/79, 83, 374, 439/686, 695, 59, 62, 65

[56] References Cited

U.S. PATENT DOCUMENTS 5,037,316 8/1991 Fukushima et al. ..... 439/83

5,184,963 2/1993 Ishikawa ..... 439/79

5,286,207 2/1994 McHugh ..... 439/79

*Primary Examiner*—P. Austin Bradley

*Assistant Examiner*—T. C. Patel

*Attorney, Agent, or Firm*—Robert W.J. Ushor

[57] ABSTRACT

A right angled header connector assembly including a main housing having a circuit board connecting face from which respective circuit board connecting portions protrude horizontally rearward and forward therefrom for reflow soldering to the circuit board and a transverse mating face. A subhousing is releasably attachable to the main housing to extend forward at the mating face surrounding the mating portions of the contact elements and in adjacent covering relation to the forward protruding circuit board connecting portions subsequent to the reflow soldering step. Release of the subhousing from the mating face, enables access to the forward protruding circuit board connecting portions for the reflow soldering step, unimpeded by said subhousing.

10 Claims, 7 Drawing Sheets

Fig. 7 (A) PRIOR ART
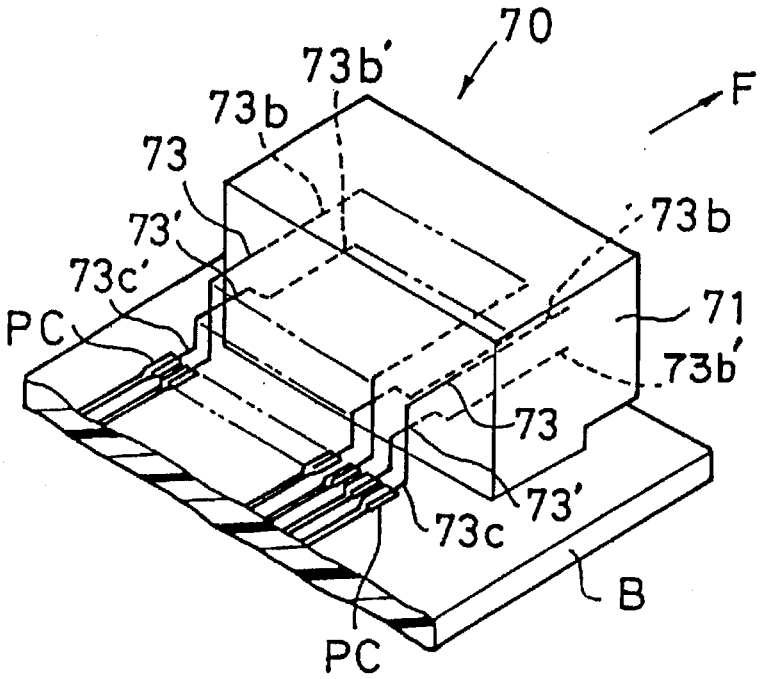
Fig. 7 (B) PRIOR ART
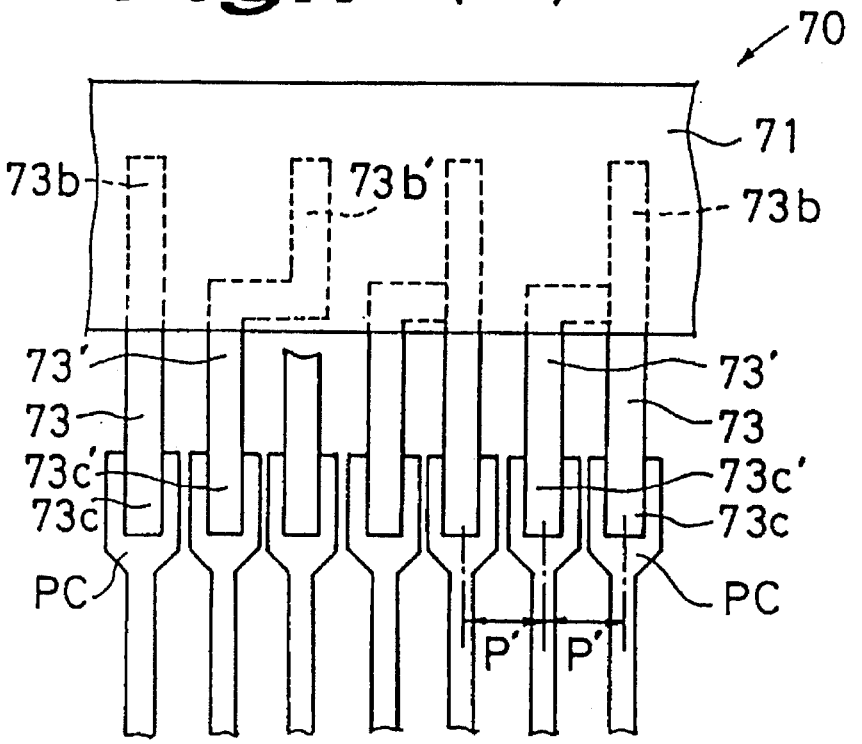

ELECTRICAL CONNECTOR ASSEMBLY

FIELD OF THE INVENTION

The invention relates to an electrical connector assembly of the right angle header type for mounting on the surface of a printed circuit board by a reflow solder technique.

BACKGROUND OF THE INVENTION

A known electrical connector assembly 70 of the right angle header type, shown in FIGS. 7*a* and 7*b*, comprises an elongate insulating housing 71 with a first portion having a board connecting face and a second portion extending forward at right angles from the first portion and having a mating face, remote from the board engaging face, for mating engagement (in direction of arrow F) with a complementary mating face of another connector. A series of contact elements 73,73' extend through the insulating housing 71 with respective mating portions 73*b*,73*b'* at the mating face for connection to respective contact elements of the other connector and respective circuit board connecting portions 73*c*,73*c'* at the board connecting face protruding horizontally, rearward thereof for connection to respective printed circuit paths PC on the surface of the circuit board B by a reflow solder technique. The mating portions 73*b*, and 73*b'* are in vertical alignment and lead portions of the contact elements 73*b'* extending from the housing rear are cranked so that the board connecting portions 73*c* and 73*c'* are substantially coplanar with the base if the housing and laterally aligned in alternating relation. The first housing portion upstands from the circuit board and a part of the second housing portion forming the mating face extends forward in adjacent overlying relation to the surface of the circuit board B.

The solder joints are formed by application of heater tips to the rearward protruding board connecting face of cream solder which has been prepainted onto the circuit board B and then by heating the assembly in an oven to effect solder reflow.

To satisfy the inexorable increase in the complexity of and miniaturization of electronic devices, such connectors must accommodate an increasingly large number of contact elements at increasingly high density requiring that the board connecting face 73*c*,73*c'* protrude from the board connecting face at increasingly close pitches P', with a corresponding increase in the narrowness of the pitches of the conductive paths of the circuit board and the pads of cream solder thereon. In consequence, there is an increase in the risk of solder bridges and resultant cross-connection being formed between adjacent conductive paths during the reflow solder process.

If some of the circuit board connecting portions of the contact elements were to extended forward from the board connecting portions, the overall density or pitch would be reduced correspondingly and the risk of solder formation also reduced. However, as a forward extending part of the second housing portion forming the mating face must be located in adjacent overlying relation to the surface of the circuit board to satisfy the requirement for low height, the forward extending part would also closely overlie and cover any board connecting portions which protruded forward from the board connecting face thereby causing obstruction, obscuring and interfering with the application of the heating tips and possibly preventing sufficient heat transfer during the reflow process in the oven preventing effective soldering and resulting in unreliable connections.

SUMMARY OF THE INVENTION

It is an object of the invention to obviate or ameliorate at least some of the above-mentioned disadvantages by providing a connector of the right angled header type in which the pitch of the board connecting portions can be widened by providing a connector assembly in which board connecting portions of the contact elements can protrude forward from the board connecting face without interfering or hindering the reflow soldering process.

According to one aspect of the invention, in a connector of the above described type, circuit board connecting portions located at the board connecting face protrude forward therefrom and said part of the second housing portion is formed as a subhousing part and means are provided for attaching or retrofitting said subhousing part to extend in adjacent overlying relation both to the surface of the circuit board and covering the forward protruding board connecting portions after reflow soldering thereof to the printed circuit board, thereby permitting the solder reflow process to be carried out unimpeded by said subhousing part, resulting in reliable electrical connection.

Thus an overall widening of the pitch can be obtained with a corresponding reduction in the risk of accidental solder bridge formation.

Preferably, the attaching means releasably attaches the subhousing part of the second housing portion which forms the mating face to permit removal thereof to enable unimpeded inspection, replacement or repair of a solder joint.

In one example of the invention, the attached or retrofitted subhousing part of the second housing portion comprises a hood and the attaching means mounts the hood extending forward, surrounding the mating portions of the contact element means at the mating face.

Preferably, the attaching means comprises cooperable detent or indent means on the attachable subhousing part and at a location on the remainder of the housing interengageable to releasably attach the subhousing part to the remainder of the housing.

In another example of the invention, the attachment means mounts said subhousing part for pivotal movement between a position in which the hood is remote from the forward protruding board connecting portions and a position in which the hood extends in adjacent overlying relation to the forward protruding board connecting portions, forming the mating face.

In one embodiment, the attachable subhousing part may comprises substantially all of the second housing portion and the first housing portion has an upward directed assembly connecting face opposite the board connecting face and the second housing portion has a downward directed assembly connecting face remote from the mating face and the contact element means include complementary mating contact portions on the respective contact elements extending to the respective assembly connecting faces so that the assembly connecting faces are intermatable to bring mating portions of the contact elements of the first housing portion into electrical connection with mating portions of the contact elements of the second housing portion to provide electrical continuity between respective board connecting portions and respective mating portions and to bring the subhousing into adjacent overlying relation to the forward protruding board connecting portions and to the surface of the circuit board.

BRIEF DESCRIPTION OF THE DRAWINGS

Embodiments of connector assemblies according to the present invention are described below, by way of example only, and with reference to the accompanying drawings in which:

FIG. 7*a* is a schematic perspective view of a conventional electrical connector assembly;

FIG. 7*b* is a fragmentary plan view of the connector assembly shown in FIG. 7*a*.

DESCRIPTION OF PARTICULAR EMBODIMENTS

Figure 1:
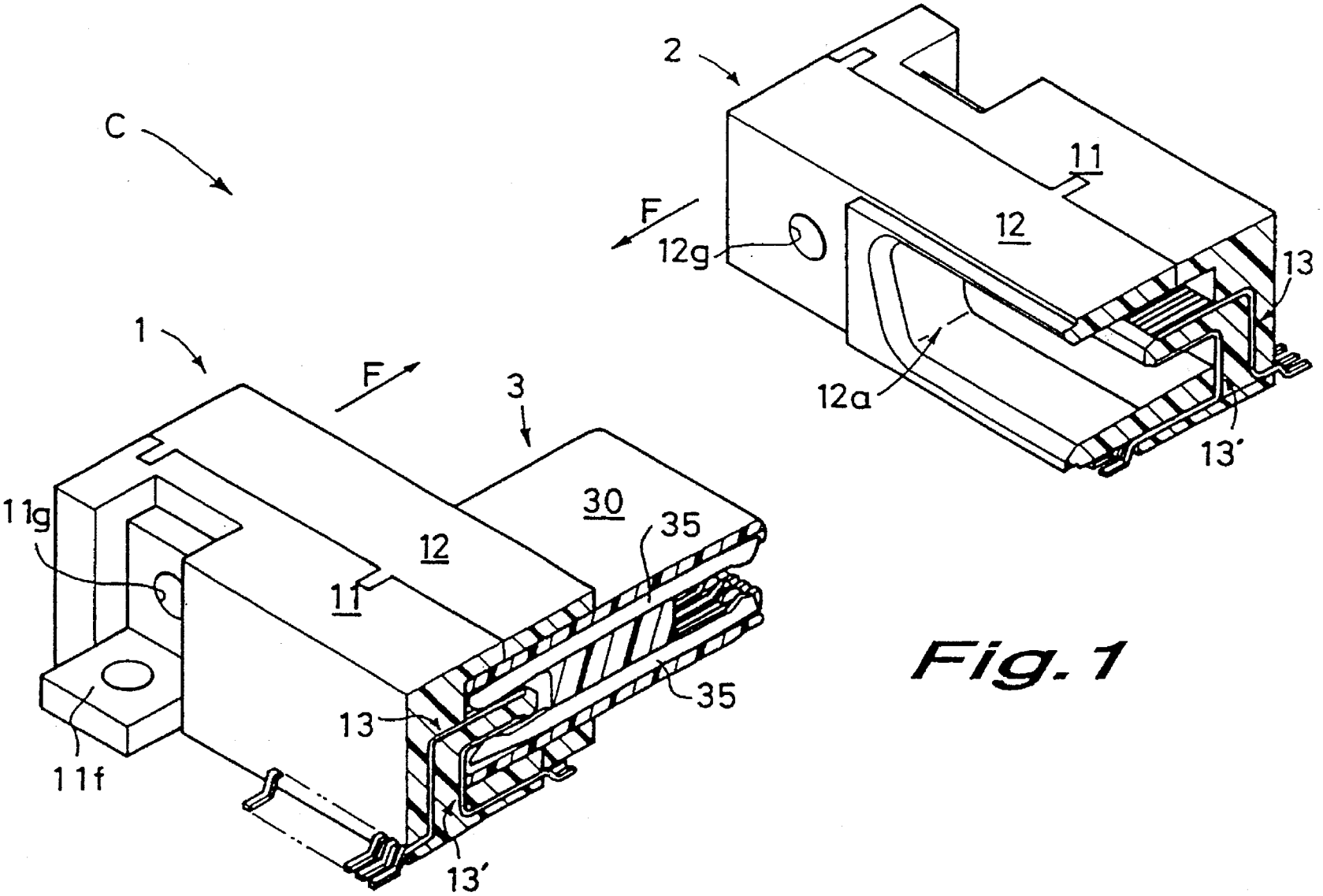
FIG. 1 is a perspective view, partly in cross-section, of a first embodiment aligned for connection to an identical complementary connector.
Figure 2:
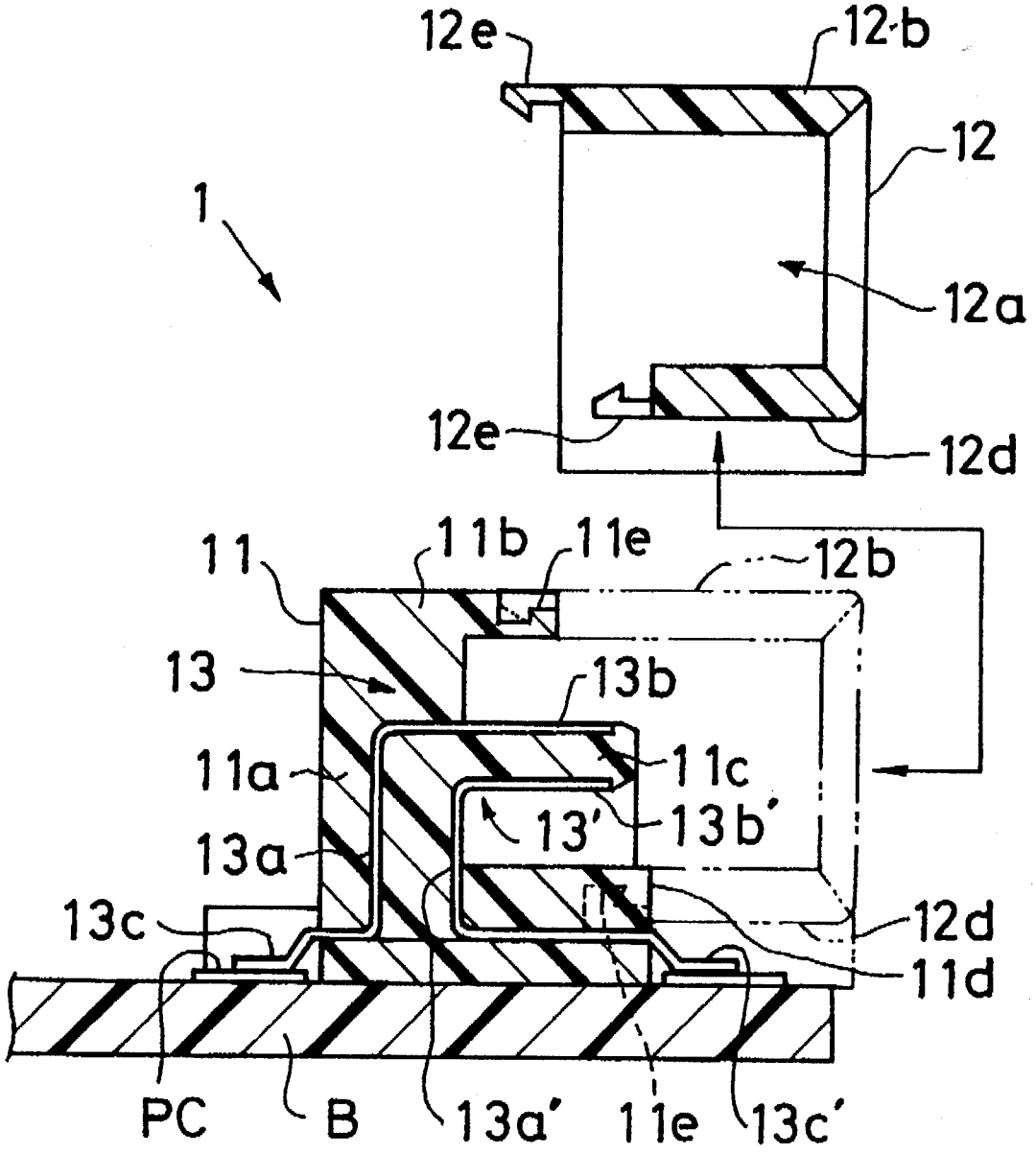
FIG. 2 is a cross-sectional view of the first embodiment to a larger scale, mounted on a circuit board with a releasably attachable part of a second housing portion thereof which forms a mating face shown in detached condition from a first housing portion.

As shown in FIGS. 1 and 2, an electrical connector assembly pair comprises a connector assembly 1 aligned for connection to an identical connector assembly 2. Each connector assembly comprises an elongate, rectanguloid, bipartite housing assembly, divided longitudinally into an elongate, main housing 11 and an elongate subhousing part 12 which is releasably attachable to an elongate front side of the main housing 11 to extend forward therefrom as shown by the arrow F.

The main housing 11 is molded from insulating resin has a first upstanding rear portion from which upper, middle and lower wall portions 11*b*, 11*c* and 11*d*, respectively, extend forward in vertical alignment to form a front face of E-shape cross section, the upper and lower walls being joined by end walls (not shown) at respective opposite longitudinal ends of the housing. Locking recesses and sockets 11*e* are formed at intervals along upper surface portion of upper wall portion 11*b* and lower surface portion 11*d* for releasably securing the subhousing 12 thereto.

A series of pairs of vertically aligned contact elements 13,13' have main portions 13*a*, 13*a*' inmolded in the main housing formed at respective opposite ends with mating portions 13*b*, 13*b*' exposed at the front on respective upper and lower faces of the middle housing portion or rib 11*c* to form a male configuration and board connecting portion 13*c*, 13*c*' extending from the main housing slightly above a board connecting face, and stepping downward by an equal amount to the level of the printed circuits PC and protrude rearward and forward, respectively, from the board connecting face.

As shown in FIG. 1, a rear face is formed with recesses adjacent respective opposite, longitudinal ends provided with mounting flanges 11*f* formed with respective through holes for securing the housing to a surface of a circuit board and through holes 11*g* for fastening to the other connector 2 of the connector pair.

As shown in FIG. 1, the subhousing part 12 is molded in one piece of insulating resin (or, alternately made of metal) as a rectangular sleeve-like hood with a central, elongate, mating aperture extending completely therethrough, front to rear, defined by upper and lower side walls 12*b* and 12*d*, respectively, and end walls. Resilient locking arms 12 with rearmost hook form, locking catches 12*e* extend rearward at intervals from rear edge portions of the upper and lower side walls 12*b* and 12*d*, respectively, with the locking hooks directed downward and upward respectively. Through holes 11*g* are formed adjacent respective opposite longitudinal ends for receipt of the fastening screw extending through hole 11*g* on the main housing 11 for fastening to the other connector assembly.

The subhousing 12 is installed on the front face of the main housing 11 above board connecting face 13*c* (as shown broken line) by engagement of respective locking arms 12*e* in respective locking recesses or indents 11*e* on main housing 11 so that the upper and lower walls 12*b* and 12*d*, respectively, of the sub housing 12, protrude forward, in line with upper wall and lower portions 11*b* and 11*d*, respectively, of the main housing 11, the lower wall being in adjacent overlying relation to the board connecting face 13', thereby forming the mating face receiving a relay connector 3. Subhousing 12 can be detached from main housing 11 by releasing locking arms 12*e* from locking indents 11*e*.

As described above and shown in FIG. 2, the connector assembly 1 is mounted on the circuit board B, by screwing the main housing 11 on to the surface of the circuit board B, and board connecting portions 13*c* and 13*c*' of each externally connecting contact element 13 and 13', are soldered onto the conductive paths (patterned layer) of the PC, so that they are surface mounted on the circuit board B. During soldering, the tops of all board connecting portions 13*c* and 13*c*' is heated by pressing engagement by the heater tips, thereby melting cream solder, which has been pasted on the PC beforehand, soldering each board connecting portion 13*c* and 13*c*' to a respective conductive paths of the PC. During this process subhousing 12 is released from main housing 11 so that it does not obstruct the heater tips enabling the soldering operation to be carried out smoothly. Furthermore, each board connecting portion 13*c* and 13*c*' can be soldered onto the conductive paths by reflowing the cream solder in an oven, while circuit board B is attached during which procedure subhousing 12 can be released from main housing 11, so as to improve the thermal conductivity around the soldering area in an efficient manner.

Figure 3:
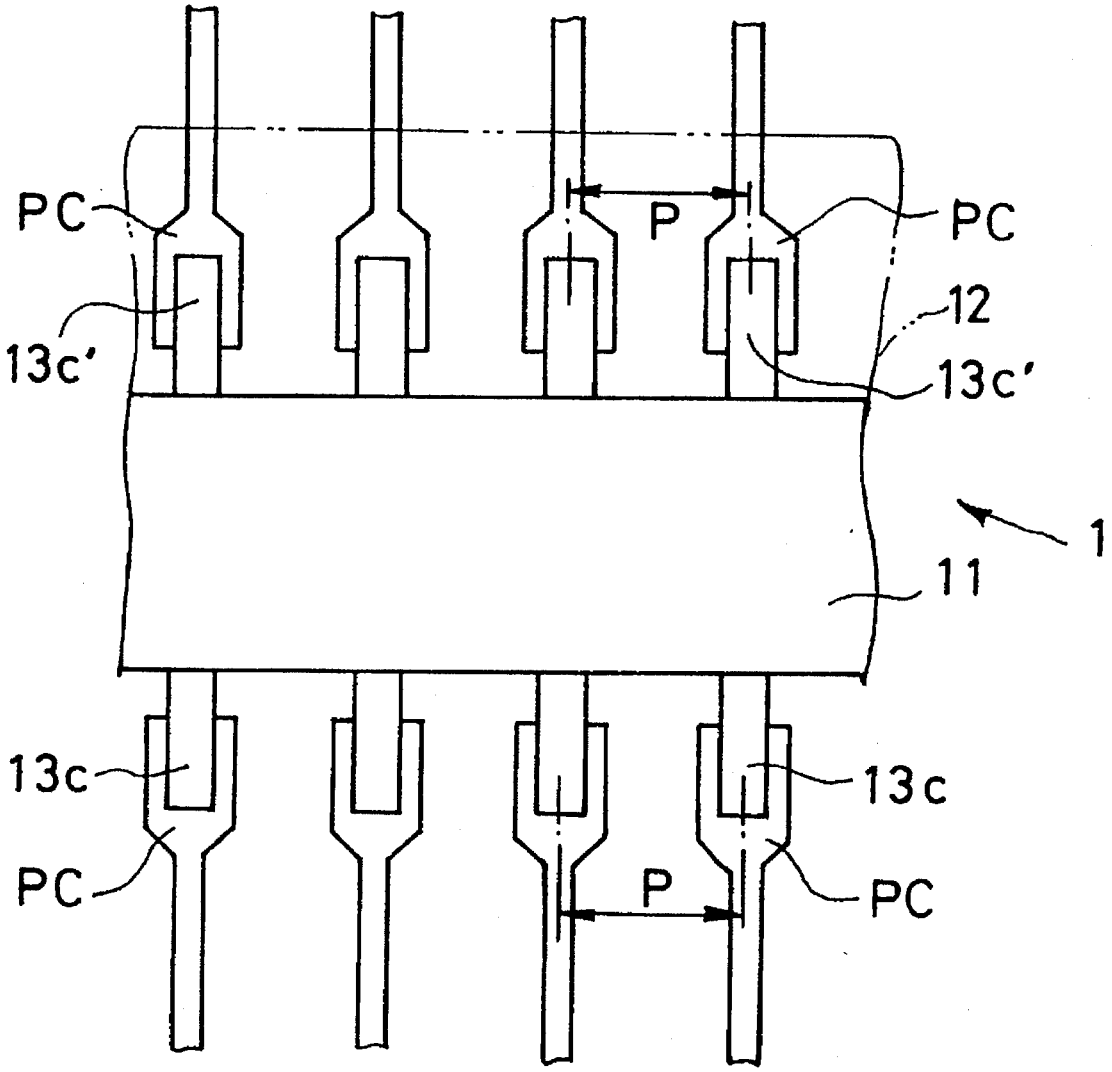
FIG. 3 is a schematic, fragmentary plan view of the first housing portion of FIG. 2.

As shown in FIG. 3, by distributing the board connecting face between front and rear sides of the housing the pitch P between board connecting portions 13*c* and 13*c*' are sufficiently wide (twice that of pitch P' of the conventional connector 50, shown in FIG. 7) permitting a corresponding increase in the separation of the conductive paths thereby obviating risk of solder brides being formed between adjacent conductive paths even if a small amount of solder flows onto the surface of the circuit board.

After the soldering process, subhousing 12 is attached in front of main housing 11 and a relay or in-line connector 3 is fitted in the cavity defined housings 11 and 12 at the mating face, as shown in FIG. 1. Relay connector 3 consists of an elongate, rectanguloid housing 30 having opposed mating faces of complementary shape to the mating face of the connector assemblies 1 and 2 and retaining a series of upper and lower contact elements 35 which extend between opposed mating faces at a corresponding pitch to the mating portions of the connector assembly and which resile apart on mating to effect pressure connection with corresponding mating portions 13*b* and 13*b*' thereby connecting the connector 1 to the relay connector 3.

The second connector 2, installed on another circuit board (not illustrated), is connected to the opposite face of relay connector 3, in the manner described above thereby interconnecting corresponding conductive paths on the two circuit boards.

Figure 4:
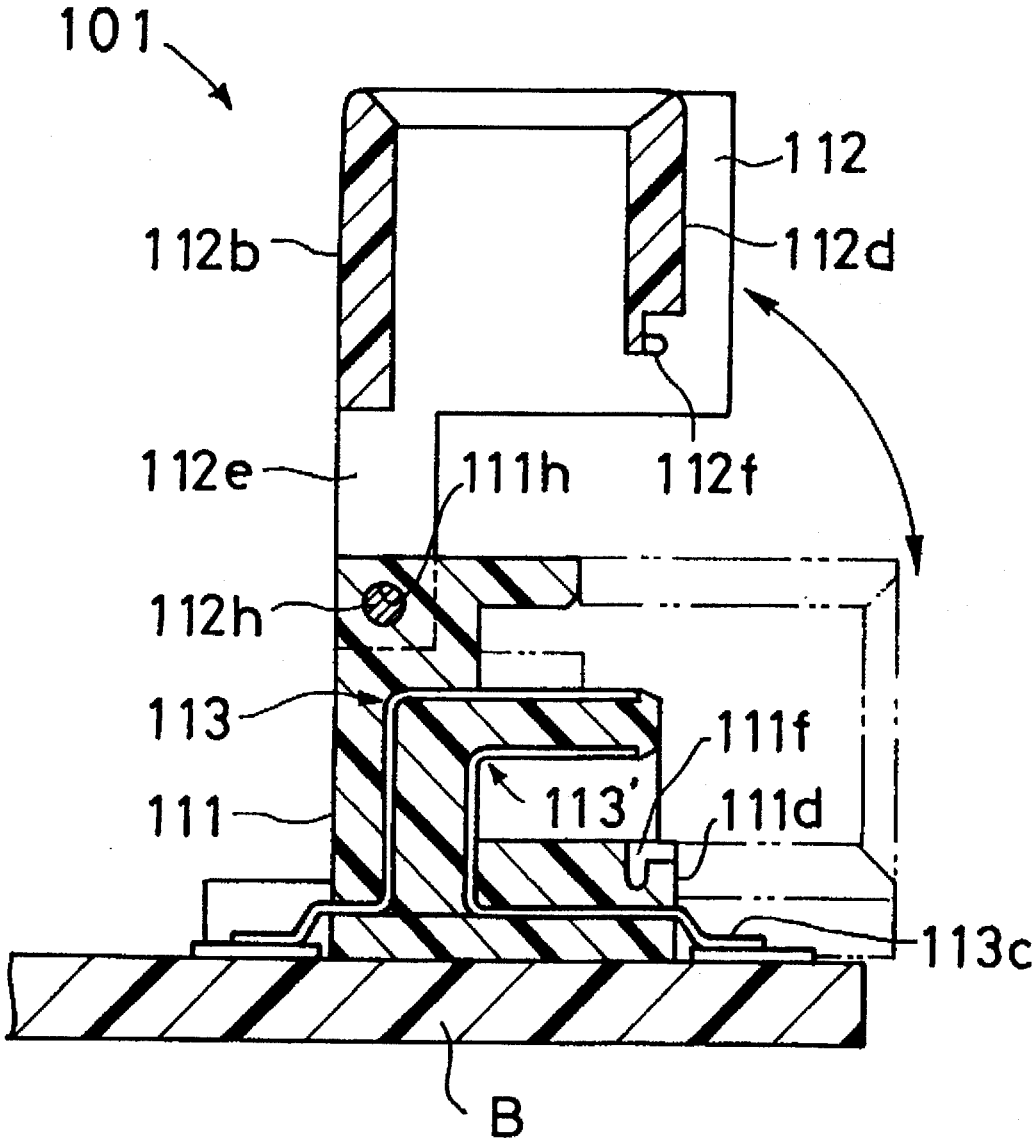
FIG. 4 is a cross-sectional view of a second embodiment' mounted on a circuit board.

In the first embodiment shown in FIG. 2, subhousing 12 is completely releasable from main housing 11, but, in an alternative construction shown in FIG. 4, it is constructed for handling as one piece with the first connector component 101. The connector assembly 101 is similar in general profile to that described above having upper and lower elongate side walls 112*b* and 112*d*. Mounting arms 112*e* having transverse stub shafts or pivot pins 112*h* on inner surfaces of respective free ends extend rearward from each end wall of subhousing 112 and subhousing 112 is pivotally attached to main housing 111 by receipt of the stub shafts into respective locking sockets 111*h* for movement between the elevated position above the main housing remote from the front and board connecting face 113*c* to the position shown in broken lines where it forms the mating face and surrounds the mating portions of the contact elements 113, 113', being locked in position by receipt of a locking detent 112*f* formed on a rear of the lower wall 112*d* in an upward opening locking recess or indent 111*f* on a lower wall portion 111*d* of the main housing as a press or snap fit.

Thus, the subhousing 112 need not obstruct access of the heater tip to the board connecting face 113*c* or impede heat conduction around the soldering area during reflow soldering in the oven.

Figure 5:
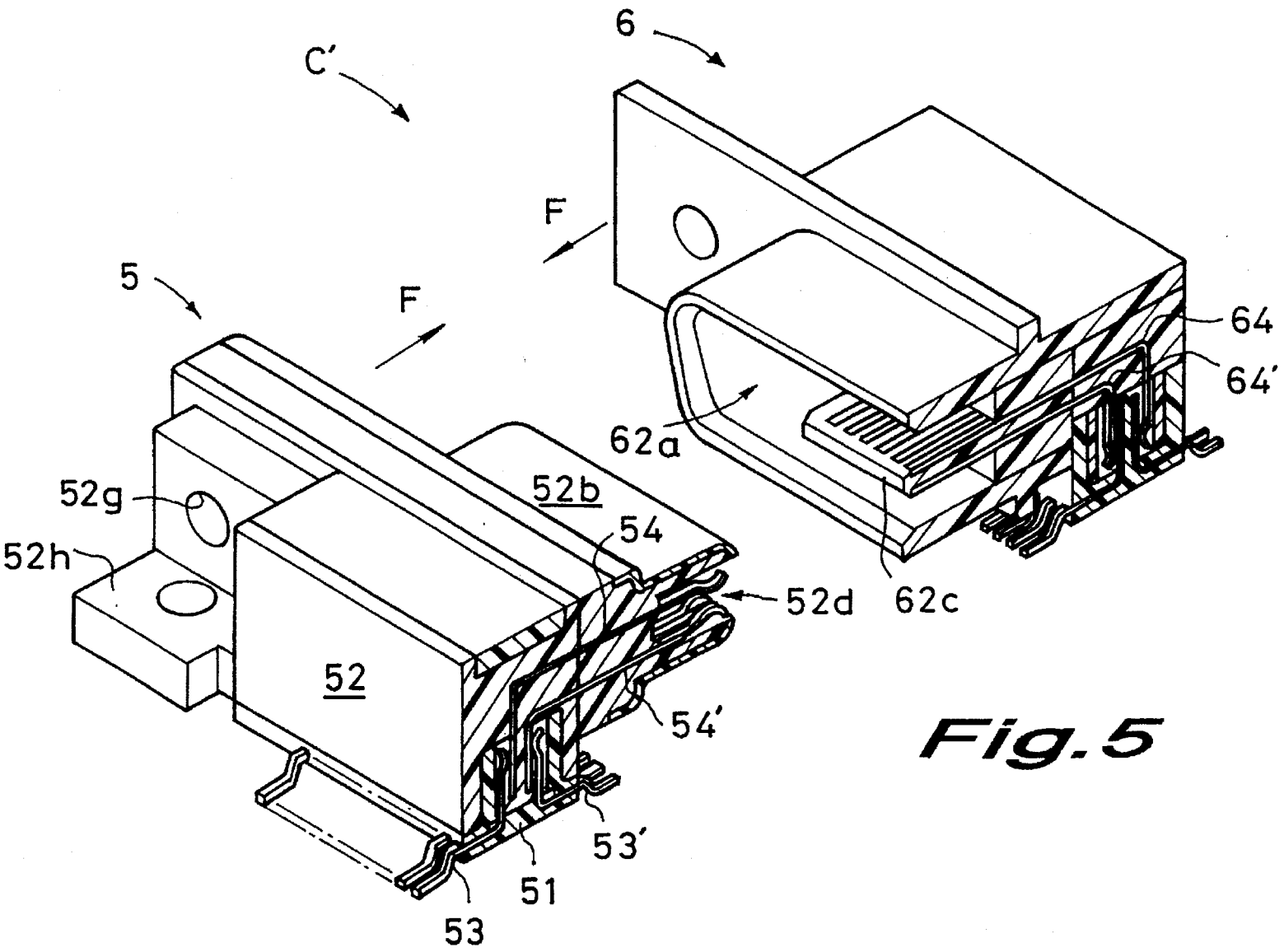
FIG. 5 is a perspective view, partly in cross-section, of a third embodiment aligned for mating with a complementary connector.
Figure 6:
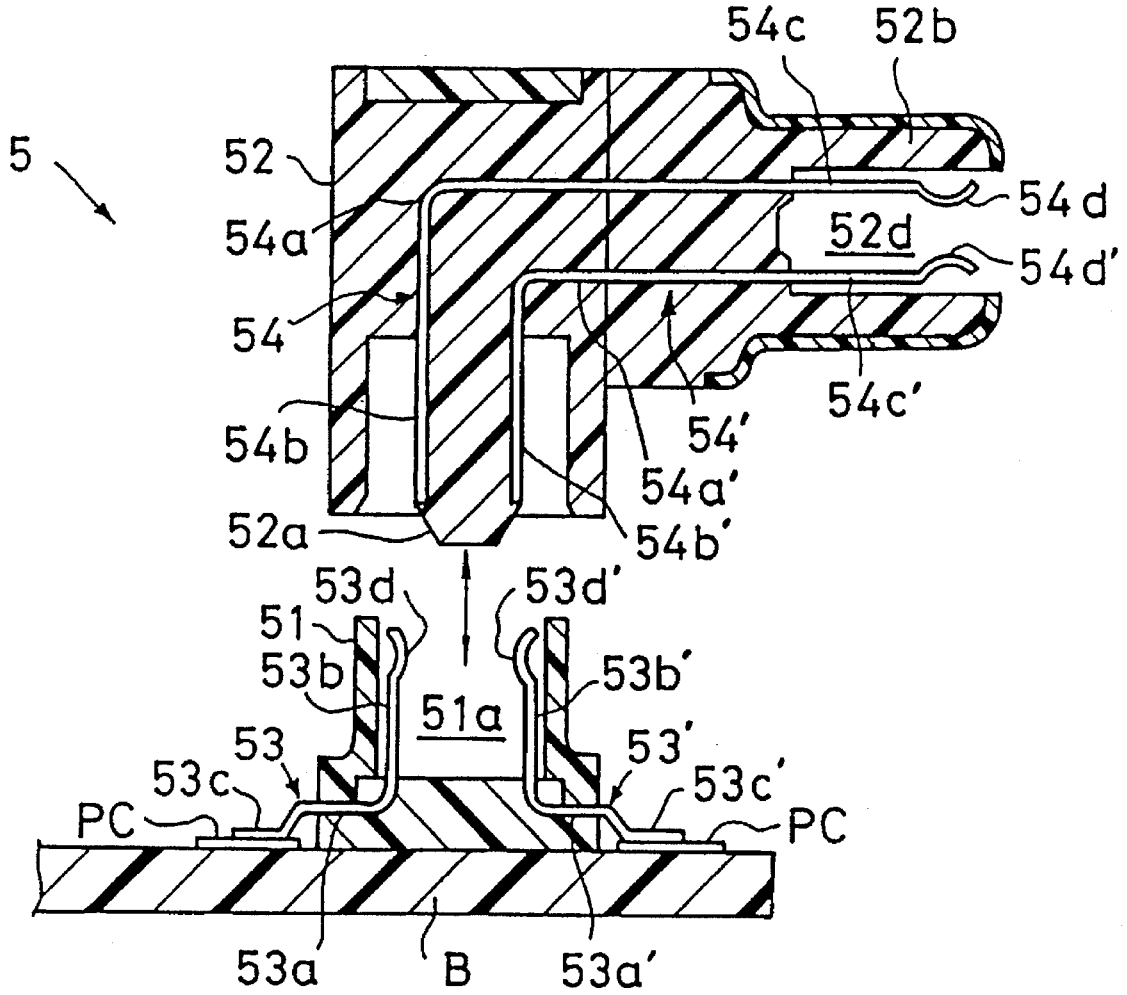
FIG. 6 is a cross-sectional view of the third embodiment to a larger scale, mounted on a circuit board with a releasably attachable part of a second housing portion thereof shown in detached condition from a first housing portion.

In a third embodiment of the invention shown on FIGS. 5 and 6, electrical connector assembly pair C' consists of first and second intermatable connector assemblies 5 and 6, respectively which are substantially identical except for having mating faces of complementary shapes.

As shown in FIG. 6, first connector assembly 5 consists of main housing 51, installed on circuit board B retaining a series of pairs of circuit board contact elements 53 and 53' and a subhousing 52, which can be freely releasably attached to the main housing by mating engagement therewith is freely detached and attached on main housing 51 and retaining a series of pairs of mating contact elements 54 and 54'.

As shown in FIG. 5, main housing is 51 formed of electrically insulating resin in elongate rectanguloid shape providing an elongate cavity 51*a* of female mating shape for mating receipt of the subhousing 52, as shown in FIG. 6.

Each circuit board contact element 53, 53' has a mid part 53*a*, 53*a*', respectively, retained (eg molded in) a lower rear portion of main housing 51; contact element part 53*b*, 53*b*' extending upward from mid part 53*a* along the interior of cavity 51*a*; and a board connecting portion 53*c*, 53*c*', respectively, extending from a respective mid part and protruding rearward and forward outside the housing 51. Inwardly protruding contact parts 53*d* and 53*d*' are formed on the free ends of respective contact element part 53*b*, 53*b*'.

Subhousing 52 is also elongate and generally L-shaped rectanguloid and molded from resin, with a lower mating face of complementary shape to that of the main housing 51 having an E-shape cross-section with a central depending rib 52*a* and a forward protruding part 52*b* defining a mating face with a forward opening mating cavity 52*d* defined buy upper lower and end walls (not shown).

As shown in FIG. 5, adjacent opposite longitudinal ends, through holes 52*g* for receipt of screws for fastening to second connector assembly 6 are formed, and a lower part has a rearward extending flange 52*h* formed with a through hole 52*h*, for receipt of a circuit board mounting screw.

A series of contact element pairs 54, 54' consist of right angled, mid parts 54*a*, which are molded in the subhousing 52 to extend through both arms of the L- shape body to lower mating contact element parts 54*b*, 54*b*', which extend downward along front and rear sides of the rib 52*a* and, forward to front resilient mating parts 54*c*, 54*c*', which extend into the front mating cavity 52*d*.

The board mounting and soldering step is performed in a similar manner to that previously described with the sub housing removed from the main housing so that the subhousing does not obstruct access to board connecting portions 53*c* and 53*c*', when applying heater tips, and soldering can be readily performed.

Subsequent to the soldering step subhousing part 52*b* is assembled with main housing 52 by mating engagement and subhousing 52 is locked in place connecting corresponding contact elements 53,53' with 54, 54', respectively.

When mounted on the circuit board, connector assembly 5 is mated with connector assembly 6, as shown in FIG. 5, by inserting front protruding part 52*b* in direction F into locking cavity 62*a* of second connector assembly 6, also mounted on the circuit board (not shown). A rib is formed centrally within locking cavity 62*a* upper and lower contact elements 64 and 64'; on respective upper and lower surfaces which electrically connect with mating portions 54*d* and 54*d*' on connector assembly 5 electrically connecting both connector assembly, 5 and 6 and corresponding conductive paths to which they are also connected Thus, the soldering operation is not impeded by the forward extending portion of the connector assembly enabling the contact pitch to be widened.

We claim:

1. An electrical connector assembly of a right angled header type for mounting on a surface of a circuit board comprising an insulating housing means with a first portion having a board connecting face and a second portion extending forward at right angles from the first portion and having a mating face, remote from the board connecting face, for mating engagement with a complementary mating face of another connector, a series of contact element means extending through the insulating housing with respective mating portions at the mating face for connection to respective contact elements of said another connector and respective circuit board connecting portions at the board connecting face some of which protrude horizontally rearward therefrom for connection to respective circuit paths on the surface of the circuit board by a reflow solder technique with the first housing portion upstanding from the circuit board and a part of the second housing portion for forming the mating face in adjacent overlying relation to the surface of the circuit board, the improvement residing in that the contact element means include other circuit board connecting portions at the board connecting face which protrude horizontally forward therefrom and that said part of the second housing portion is formed as a subhousing part and means are provided for attaching the subhousing part to form the mating face and to extend in adjacent overlying relation to both the surface of the circuit board and to the forward protruding board connecting portions after reflow soldering thereof to the printed circuit board, enabling the soldering unimpeded by said subhousing part, the circuit board connecting portions protruding horizontally forward for a distance greater than the mating portions and less than the subhousing part when attached, so that the circuit board connecting portions are exposed for direct engagement from vertically above by a soldering tool in an unattached condition of the subhousing part and completely covered by the subhousing part when attached.

2. An electrical connector assembly according to claim 1 wherein the attaching means releasably attaches the subhousing part to permit removal thereof for unimpeded access to forward protruding board connecting portions soldered to the circuit board.

3. An electrical connector assembly according to claim 1 wherein the attaching means comprises one of cooperable detent and indent means on said subhousing part and a remainder of the housing, interengageable to releasably attach the subhousing part to the remainder of the housing.

4. An electrical connector assembly according to claim 1 wherein said subhousing part comprises the second housing portion and the attaching means comprise an upward directed, assembly connecting face provided on the first housing portion at a location opposite the board connecting face and a downward directed, assembly connecting face provided on the second housing portion at a location remote from the mating face and the contact element means include complementary mating contact element portions on the respective contact elements extending to the respective assembly connecting faces so that the assembly connecting faces are intermatable to bring mating portions of the contact element portions of the first housing portion into electrical connection with mating portions of the contact elements of the second housing portion to provide electrical continuity between respective board connecting portions and respective mating portions and to bring the subhousing part into adjacent overlying relation to the forward protruding board connecting portions and to the surface of the circuit board.

5. An electrical connector assembly according to claim 1 wherein said subhousing part comprises a hood and the attaching means mounts the hood extending forward, surrounding the mating portions of the contact element means at the mating face.

6. An electrical connector assembly according to claim 5 wherein the attachment means mounts said subhousing part for pivotal movement between a position in which the hood is remote from the forward protruding board connecting portion and a position in which the hood extends in adjacent overlying relation to the forward protruding board connecting portions, forming the mating face.

7. An electrical connector assembly of a right angled header type for mounting on a surface of a circuit board comprising a main insulating housing having a board connecting face and a mating face at right angles to the board connecting face for mating engagement with a complementary mating face of another connector, a series of one-piece contact elements extending through the insulating housing and having respective mating portions at the mating face for connection to respective contact elements of said another connector and respective circuit board connecting portions at the board connecting face protruding horizontally rearward and forward therefrom for connection to respective circuit paths on the surface of the circuit board by a reflow soldering step with the board connecting face engaging the circuit board and with the mating face directed forward and located rearward of the forward protruding circuit board connecting portions, and a subhousing comprising a hood and means for releasably attaching the subhousing to the main housing to extend forward at the mating face surrounding the mating portions of the contact elements and in adjacent covering relation to the forward protruding circuit board connecting portions subsequent to the reflow soldering step, the circuit board connecting portions protruding horizontally forward for a distance greater than the mating portions and less than the subhousing part when attached to the main housing, so that the circuit board connecting portions are exposed for direct engagement from vertically above by a soldering tool in an unattached condition of the subhousing part and completely covered by the subhousing part when attached whereby, release of the subhousing from the mating face, enables access to the forward protruding circuit board connecting portions for the reflow soldering step, unimpeded by said subhousing.

8. An electrical connector assembly according to claim 7 wherein the attaching means includes pivot means mounting the subhousing part for pivotal movement between a position in which the hood is remote from the forward protruding board connecting portions and a position in which the hood extends forward at the mating face surrounding the mating portions of the contact elements and in adjacent covering relation to the forward protruding circuit board connecting portions.

9. An electrical connector assembly according to claim 7, in which the attaching means comprises one of cooperable detent and indent means on said subhousing and said main housing.

10. An electrical connector assembly according to claim 9 wherein the attaching means includes pivot means mounting the subhousing part for pivotal movement between a position in which the hood is remote from the forward protruding board connecting portions and a position in which the hood extends forward at the mating face surrounding the mating portions of the contact elements and in adjacent covering relation to the forward protruding circuit board connecting portions.

* * * * *